United States Patent [19]

Dyer

[11] 4,355,637

[45] Oct. 26, 1982

[54] SURGICAL MASKS

[75] Inventor: Alan Dyer, Manchester, England

[73] Assignee: Laporte Industries Limited, London, England

[21] Appl. No.: 127,069

[22] Filed: Mar. 4, 1980

[30] Foreign Application Priority Data

Mar. 9, 1979 [GB] United Kingdom ..... 7908368

[51] Int. Cl.[3] ..... A62B 7/10

[52] U.S. Cl. ..... 128/206.19; 128/205.27

[58] Field of Search ..... 128/202.26, 205.27, 128/205.28, 205.29, 206.12, 206.13, 206.15, 206.16, 206.17, 206.19, 206.21; 423/328, 239; 55/389, DIG. 35, 75

[56] References Cited

U.S. PATENT DOCUMENTS

| | | | |
|---|---|---|---|
| Re. 28,102 | 8/1974 | Mayhew | 128/206.19 |
| 2,922,418 | 1/1960 | Heffernan et al. | 128/206.15 |
| 3,015,369 | 1/1962 | Brennan | 55/75 X |
| 3,316,904 | 5/1967 | Wall et al. | 128/206.12 |
| 3,333,585 | 8/1967 | Barghini et al. | 128/204.13 |
| 3,884,227 | 5/1975 | Lutz et al. | 128/206.19 |
| 3,941,573 | 3/1976 | Chapel | 55/389 X |
| 3,971,373 | 7/1976 | Braun | 128/206.19 |
| 4,129,424 | 12/1978 | Armond | 55/389 X |
| 4,157,375 | 6/1979 | Brown et al. | 423/239 |

FOREIGN PATENT DOCUMENTS 1964739 6/1971 Fed. Rep. of Germany .

OTHER PUBLICATIONS

Breck, *Zeolite Molecular Sieves, Structure, Chemistry, and Use,* pp. 699–709.

*Primary Examiner*—Henry J. Recla
*Attorney, Agent, or Firm*—Larson and Taylor

[57] ABSTRACT

It has already been suggested that chronic exposure of humans to nitrous oxide is a potential health hazard. There is especial concern for those working in the vicinity of a patient to whom nitrous oxide is administered as an anaesthetic. The present invention provides a disposable surgical mask characterized in that a layer comprising particles of a molecular sieve based on silicon dioxide and having an affinity for nitrous oxide is disposed between adjacent layers of the mask. Wearing such a mask reduces personal exposure to nitrous oxide.

11 Claims, 1 Drawing Figure

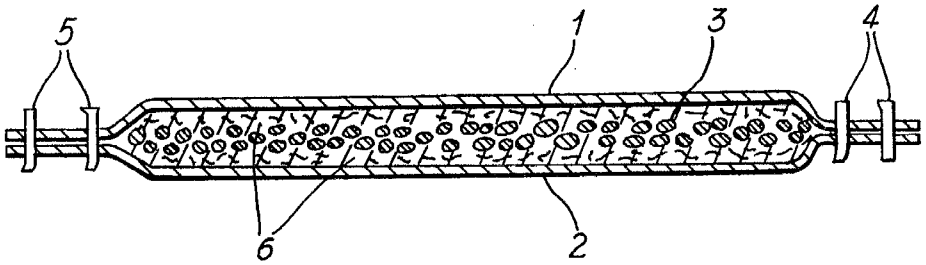
5
1
3
4
6
2

SURGICAL MASKS

The present invention relates to surgical masks.

The wearing of a surgical mask has hitherto had as its prime purpose the protection of the patient from infection by those working on him or in his vicinity. Formerly, surgical masks were commonly used, sterilised, and reused repeatedly. Nowadays, disposable surgical masks (worn only once) are generally preferred.

Nitrous oxide is widely used as an anaesthetic gas, both in hospitals and in dentists' surgeries. The details of such administration are well known and will not be described here. The important feature of such administration, for present purposes, is that it commonly leads to significant nitrous oxide contamination of the atmosphere in the vicinity of the patient, and this constitutes a potential health hazard for the workers in the anaesthetic room, operating theatre, or surgery, etc. Of course, the patient is exposed to much higher concentrations of the anaesthetic than the workers, but the workers' exposure, unlike that of the patients, will generally be chronic. The U.S. National Institute for Occupational Safety and Health has recommended that the concentration should not be allowed to exceed 30 p.p.m. (U.S. Department of Health, Education and Welfare, publication No. DHEW (N.I.O.S.H.) 75/137 (1975)). In practice, workers are very often exposed to concentrations many times greater than this.

Techniques are known for reducing the nitrous oxide concentration in the atmosphere near the patient (such as "scavenging", ventilation of the room in question, and full air-conditioning of the room). These involve considerable expense and are not always applicable or effective in given circumstances. The present invention is concerned with a different approach to the problem involving the protection of the individual at risk with a disposable surgical mask. The effect of wearing the mask is to reduce the intake of nitrous oxide into the lungs of the individual compared with the intake which would be expected, under like conditions of atmospheric contamination, if the individual wore a conventional disposable surgical mask. The wearing of such a mask can of course be combined with measures to reduce the atmospheric contamination.

The present invention provides a disposable surgical mask characterised in that a layer comprising particles of a molecular sieve based on silicon dioxide and having an affinity for nitrous oxide is disposed between adjacent layers of the mask.

Simple tests can be used to determine whether any given molecular sieve has an affinity for nitrous oxide. For instance, one may pass nitrous oxide in a stream of carrier gas (for instance oxygen, nitrogen, or air) through a column containing the sieve; if the sieve has affinity for the nitrous oxide, nitrous oxide will be retained in the sieve and the nitrous oxide concentration in the mixture emerging from the column will be less than that entering the column, although of course the concentration will rise as the sieve approaches saturation with nitrous oxide.

An important class of molecular sieves based on silicon dioxide are the zeolites, and among the zeolites there are materials having an affinity for nitrous oxide.

The zeolite molecule sieve known as 5A is one which has an affinity for nitrous oxide. 5A is an A-type zeolite having a nominal pore size of 5 Å. 5A zeolites as commercially available generally consist of sodium zeolite A $Na_2O.Al_2O_3.2SiO_2.xH_2O$ wherein about three-quarters of the sodium has been exchanged for an equivalent amount of calcium.

5A, however, has considerable affinity for water vapour, which of course will be passed through the mask when the mask is used (both on inhalation and on exhalation). The adsorption of this water vapour is exothermic, and therefore it is preferable for the comfort of the wearer if 5A has been loaded with water before the mask is put on. Alternatively, the problem may be dealt with by appropriate mask design. Surgical masks usually stand clear of the mouth and nostrils and contact the face only at the edges; with appropriate choice of construction and materials, transmission of heat from the zeolite to the wearer's face can be reduced to a tolerable level.

Other molecular sieves based on silicon dioxide and which may be used are those described by the general term "silicalite" (see, for instance, U.S. Pat. No. 4,061,724). These materials are said to have a pore size of approximately 6 Å. The materials have a very high silica content. For instance, one of the products referred to in U.S. patent 4,061,724 is said to correspond to the following formula in terms of oxides—

$$1.0(TPA)_2O.0.63K_2O.55.7SiO_2.9.5H_2O,$$

where TPA indicates a tetrapropylammonium group. There is some alumina present but at the level of an impurity (591 ppm).

An advantage of silicalite is that it generally does not generate substantial amounts of heat by reaction with water.

Disposable surgical masks as presently manufactured usually consist of two layers of air-permeable woven or non-woven fabric, especially paper, which may be joined only peripherally or may be stuck together relatively lightly by adhesive over most or all of their area. The mask provided by the present invention has an extra layer between the two conventional layers. It is possible, of course, for the mask provided by the present invention to have three or more conventional layers, with an extra layer disposed between one or more of the pairs of adjacent layers. This extra layer comprises the molecular sieve. It is, of course, possible for two or more suitable molecular sieves to be used in the layer.

A reasonably uniform distribution of the molecular sieve over that area of the layer through which air is inspired by the wearer is desirable, since this ensures a reasonably good depletion of the nitrous oxide in the inspired air. One way in which such a reasonably uniform distribution can be achieved is by the inclusion in the layer of a compressible packing material, for example cotton wool. (Cotton wool or the like is a known filler for dust masks, but in them it serves a filtering function.) The compressible packing material tends to hold the molecular sieve particles in place and to prevent them from shaking down in the mask during use.

The layers to either side of the layer comprising the molecular sieve may be any woven or non-woven fabric suitable for disposable surgical masks. Paper is a preferred material.

The mask is preferably designed so as to stand clear of the mouth and nostrils.

When the mask is in use, the layered part of the mask may be held in proper position relative to the wearer by any suitable means. For instance, there may be a single stretchable band attached to the layered part of the mask at two points; this band is for passing around the back of the wearer's head. Alternatively, there may be attached to the layered part of the mask two stretchable bands which are for passing behind the wearer's ears. The mask may also include bendable stiffeners, for example a stiffener to be bent around the nose so as to achieve a close fit of the mask to the face.

It is possible for the mask to include adsorbents other than molecular sieves used in accordance with the invention. For instance, it may include adsorbents for other contaminant gases (especially other anaesthetic gases) or for water. An adsorbent for water may be valuable to avoid adsorption of water on the molecular sieve of the type specified above; this may be of value if it is desired to reduce the exothermic adsorption of water by the molecular sieve used in accordance with the invention, or to prevent reduction of the sieve's capacity for nitrous oxide by the adsorption of water, if such would otherwise occur. An adsorbent of the type we are referring to here may be included in the same layer as the molecular sieve, or in (a) separate layer(s).

The present invention will now be more particularly described with reference to the accompanying FIGURE, which is a cross section of the layered part of a mask in accordance with the invention. Means for attachment to the face are not shown.

In the FIGURE, 1 and 2 are sheets of air-permeable woven or non-woven fabric, preferably paper. 3 represents particles of a molecular sieve based on silicon dioxide and having an affinity for nitrous oxide. 6 represents a compressible packing material, for example cotton wool. 4 and 5 indicate peripheral stitching.

3 and 6 together constitute the layer comprising particles of the molecular sieve referred to above, and 1 and 2 are the layers between which it is disposed. In the FIGURE, therefore, the layer consists of one sub-layer of molecular sieve 3 and two sub-layers of compressible packing material 6. However, this feature shown in the FIGURE is not believed to be of particular importance, and the layer constituted by 3 and 6 together may instead be a relatively homogeneous one in which the packing material 6 and the molecular sieve particles 3 are mixed up together, or one in which there is more than one sub-layer of molecular sieve.

The invention will now be further more particularly described by means of Examples resulting to various masks in accordance with the invention.

In all of the Examples, the layered part of the mask had the cross-section in the FIGURE, except that adhesive tape fulfilled the function of stitching 4, 5 and that in some of the Examples (as specifically indicated below) the relative arrangement of compressible packing and molecular sieve was different. 1 was gauze and 2 was a thin non-woven fabric containing threads. Both of these materials were taken from a Martindale protective mask "for nuisance dusts only" (Martindale Protection Ltd, Neasden Lane, London NW10 1RN). The compressible packing material was cotton wool, from the same Martindale protective mask. The masks were fitted onto a machine which passed through the central portion of the mask (corresponding roughly to the area through which a wearer would inspire) a mixture of air and nitrous oxide, in the direction from 2 to 1, the pressure on side 2 being only slightly above atmospheric. All nitrous oxide concentrations were determined by an infra-red gas analyser.

EXAMPLE 1

The mask contained 25 g of zeolite 5A bound pellets as supplied by Laporte Industries Limited, General Chemicals Division, Widnes, England. The pellet size was 2–4 mm. The concentration of nitrous oxide in the air entering the mask from the one side was 207 ppm, and the rate of flow of the mixture was 5 liter $min^{-1}$.

The nitrous oxide concentration in the mixture emerging from the other side of the mask, as a function of time, was as follows (time=0 when flow is commenced):

| | | | | | | |
|---|---|---|---|---|---|---|
| time/min: | 2.0 | 2.5 | 4.0 | 15.2 | 35.75 | 40.0 |
| concentration/ppm: | 9 | 17 | 26 | 53 | 65 | 76 |

EXAMPLE 2

Example 1 was repeated but with 821 ppm nitrous oxide in the air entering the mask from the one side. The results were as follows:

| | | | | |
|---|---|---|---|---|
| time/sec: | 36 | 83 | 120 | 175 |
| concentration/ppm: | 65 | 200 | 254 | 317 |

EXAMPLE 3

Example 1 was repeated but with 1600 ppm nitrous oxide in the air entering the mask from the one side. The results were as follows:

| | | | | |
|---|---|---|---|---|
| time/sec: | 12 | 22 | 40 | 185 |
| concentration/ppm: | 25 | 543 | 2 362 | 12 682 |

EXAMPLE 4

In this Example, 50 g of zeolite 5A was used. The arrangement of compressible packing 6 and of molecular sieve 3 was different from that shown in the FIGURE in that 25 g of sieve was held at the boundary between 6 and 1 and 25 g was held at the boundary between 6 and 2. The materials themselves were the same as in Examples 1 to 3.

The air which was passed into the mask from the one side contained 2 165 ppm of nitrous oxide. The flow rate was 5 liter $min^{-1}$. The concentration of nitrous oxide in the gas emerging from the other side, as a function of time, was as follows:

| | | | |
|---|---|---|---|
| time/sec: | 23 | 73 | 84 |
| concentration/ppm: | 25 | 200 | 253 |

EXAMPLE 5

Example 4 was repeated but with 13 807 ppm nitrous oxide in the air entering the mask from the one side. The results were as follows:

| | | | |
|---|---|---|---|
| time/sec: | 8 | 19 | 60 |
| concentration/ppm: | 25 | 317 | 2034 |

EXAMPLE 6

Example 4 was repeated with 2 559 ppm nitrous oxide in the air entering the mask from the one side and after a pretreatment of the mask involving wearing it periodically in an atmosphere free of nitrous oxide until the wearer could no longer detect heat evolution (presumed to arise from the reaction of the zeolite with water). The pretreatment left the mask active for the removal of nitrous oxide, as the following results show:

| | | | |
|---|---|---|---|
| time/sec: | 32 | 64 | 183 |
| concentration/ppm: | 25 | 104 | 207 |

EXAMPLE 7

Example 4 was repeated with 190 ppm nitrous oxide in the mixture entering the mask from the one side and after a pretreatment of the mask involving immersing it in water and roughly drying it off with a cloth. The result was that for 5 minutes no nitrous oxide was detected in the mixture emerging from the other side of the mask.

EXAMPLE 8

Example 1 was repeated, except that the molecular sieve used was silicalite prepared according to Example 3 of U.S. Pat. No. 4,061,724 (without calcination), and that there was 1 311 ppm nitrous oxide in the mixture entering the mask from the one side. The results were as follows:

| | | | |
|---|---|---|---|
| time/sec: | 24 | 54 | 272 |
| concentration/ppm: | 26 | 112 | 222 |

I claim:

1. An improved disposable surgical mask of the type comprising at least two layers, wherein the improvement comprises a layer comprising particles of a molecular sieve based on silicon dioxide and having an affinity for nitrous oxide, which layer is disposed between two adjacent layers of the mask, said particles being present in said layer in an amount of not more than 50 grams.

2. A disposable surgical mask according to claim 1, wherein the molecular sieve is a zeolite.

3. A disposable surgical mask according to claim 2, wherein the zeolite is a 5A zeolite.

4. A disposable surgical mask according to claim 2, wherein the zeolite has been loaded with water.

5. A disposable surgical mask according to claim 1, wherein the molecular sieve is silicalite.

6. A disposable surgical mask according to claim 1, wherein at least one of the layers between which the layer comprising the molecular sieve is disposed is of paper.

7. A disposable surgical mask according to claim 1, wherein the layer comprising the molecular sieve includes, in addition to the molecular sieve, a compressible packing material.

8. A disposable surgical mask according to claim 7, wherein the compressible packing material comprises cotton wool.

9. A disposable surgical mask according to claim 1, wherein said molecular sieve is the sole material located in said layer and having an affinity for nitrous oxide.

10. A surgical face mask according to claim 1 wherein material present in said layer and having an affinity for nitrous oxide consists essentially of said molecular sieve particles.

11. A method for the protection of a human being from nitrous oxide in the atmosphere which comprises fitting the human being with a disposable surgical mask according to claim 1 so as to ensure that at least a major proportion of the air inspired passes through the mask.

* * * * *